United States Patent [19]

Sung et al.

[11] Patent Number: 4,533,361

[45] Date of Patent: Aug. 6, 1985

[54] MIDDLE DISTILLATE CONTAINING STORAGE STABILITY ADDITIVE

[75] Inventors: Rodney L. Sung, Fishkill, N.Y.; Thomas J. Karol, Norwalk, Conn.

[73] Assignee: Texaco Inc., White Plains, N.Y.

[21] Appl. No.: 658,933

[22] Filed: Oct. 9, 1984

[51] Int. Cl.[3] ..... C10L 1/22

[52] U.S. Cl. ..... 44/73; 44/74; 44/75; 44/71; 548/546

[58] Field of Search ..... 44/73, 74, 75, 63; 548/546; 252/51.5 R

[56] References Cited

U.S. PATENT DOCUMENTS

| | | | |
|---|---|---|---|
| 2,458,527 | 1/1949 | Oberright | 44/73 |
| 2,984,550 | 5/1961 | Chamot | 44/73 |
| 4,090,854 | 5/1978 | Davis | 44/73 |
| 4,157,308 | 6/1979 | Wilgus et al. | 252/51.5 R |
| 4,166,726 | 9/1979 | Harle | 44/73 |
| 4,186,102 | 1/1980 | Malec | 44/73 |

*Primary Examiner*—Y. Harris-Smith

*Attorney, Agent, or Firm*—Robert A. Kulason; James J. O'Loughlin; Carl G. Seutter

[57] ABSTRACT

A middle distillate such as diesel fuel of improved storage stability contains an acylated condensate of an alkenyl succinic acid anhydride and a Mannich condensate.

27 Claims, No Drawings

MIDDLE DISTILLATE CONTAINING STORAGE STABILITY ADDITIVE

FIELD OF THE INVENTION

This invention relates to middle distillate oils. More particularly it relates to additives which provide improved storage stability for middle distillate oils.

BACKGROUND OF THE INVENTION

As is well known to those skilled in the art, middle distillate fuels typified by diesel oil, Avjet fuel, fuel oils, kerosene, etc. may be stored for extended periods of time under unfavorable conditions which are conducive to formation of solid deposits. These deposits, which are produced during storage at room temperature in the presence of air, accumulate on strainers, filters, screens, etc. with which the oil comes into contact and ultimately plug the openings with resultant problems in operation.

The propensity of a system to form a deposit may be determined by D-2274 which provides indications of oxidative deterioration or stability of a fuel. In the Potential Deposit (PD) Test, comparable indications are obtained under more severe conditions. In this test a test specimen of oil is subject to contact with air at elevated temperature; and after 2 hours, the turbidity of the specimen is determined on a scale of 1–4. A rating of 1 or 2 is satisfactory and a rating of 3 or 4 is unsatisfactory.

It is an object of this invention to provide an improved middle distillate fuel composition characterized by improved performance as determined by the Potential Deposit Test. Other objects will be apparent to those skilled in the art.

STATEMENT OF THE INVENTION

In accordance with certain of its aspects, this invention is directed to a liquid middle distillate fuel composition comprising a major portion of a liquid middle distillate hydrocarbon fuel and a minor effective portion of additive prepared by reacting (i) a primary or secondary polyamine, (ii) an aldehyde, and (iii) a phenol containing an active hydrogen thereby forming a phenol-aldehyde-amine condensate;

reacting said phenol-aldehyde-amine condensate with (iv) a succinic acid anhydride bearing a poly olefin-derived substituent containing residual unsaturation thereby forming product phenol-aldehyde-amine Mannich condensate polyamine succinimide; and acylating said phenol-aldehyde-amine Mannich condensate polyamine succinimide with acylating agent thereby forming acylated phenol-aldehyde-amine Mannich condensate polyamine.

DESCRIPTION OF THE INVENTION

The middle distillate fuels which may be employed in practice of the process of this invention may typically include those having an ibp of 300° F.–450° F., say 369° F.; a 50% bp of 400° F.–550° F.; say 496° F.; a 90% bp of 475° F.–625° F., say 586° F.; an EP of 500° F.–650° F., say 627° F.; and an API Gravity of 25–45, say 37.3. These fuels may commonly be labelled as kerosene, fuel oil, diesel oil, No. 1-D, No. 2-D, etc. One preferred middle distillate may be a diesel oil having the following properties:

TABLE

| Property | Value |
|---|---|
| API Gravity D-1298 | 37.3 |
| Kin. Vis. cSt °40° C. D-445 | 2.27 |
| Cetane D-163 | 49.6 |
| Distillation D-86 (°F.) | |
| IBP | 369 |
| 50% | 496 |
| 90% | 586 |
| EP | 627 |

Another preferred charge may be a middle distillate fuel oil having the following typical characteristics.

TABLE

| Property | Value |
|---|---|
| API Gravity D-1298 | 43.0 |
| Kin. Vis. cSt °40°C. D-445 | 1.57 |
| Cetane D-163 | 47 |
| Distillation D-86 (° F.) | |
| IBP | 344 |
| 50% | 429 |
| 90% | 490 |
| EP | 524 |

Another preferred charge may be a No. 2 fuel oil having the following properties:

TABLE

| Property | Value |
|---|---|
| API Gravity D-1298 | 35.7 |
| Kin. Vis. cSt °40° C. D-445 | 2.40 |
| Cetane D-163 | 44.7 |
| Distillation D-86 (°F.) | |
| IBP | 388 |
| 50% | 510 |
| 90% | 596 |
| EP | 653 |

Another preferred charge may be a kerosene having the following properties:

TABLE

| Property | Value |
|---|---|
| API Gravity D-1298 | 43.0 |
| Kin. Vis. cSt °40°C. D-445 | 1.57 |
| Cetane D-163 | 47 |
| Distillation D-86 (° F.) | |
| IBP | 344 |
| 50% | 429 |
| 90% | 490 |
| EP | 524 |

Another preferred charge may be a diesel fuel having the following properties:

TABLE

| Property | Value |
|---|---|
| API Gravity D-1298 | 32.8 |
| Kin. Vis. cSt °40° C. D-445 | 2.22 |
| Cetane D-163 | 42.2 |
| Distillation D-86 (°F.) | |
| IBP | 356 |
| 50% | 495 |
| 90% | 610 |
| EP | 640 |

It is a particular feature of this invention that it is possible to improve the properties of diesel fuel cut which is prepared by high temperature and pressure hydrogenation (as typified by that obtained as product from processes identified as "H-Oil" processes etc).

This cut which is particularly characterized by poor rating on the PDT may be typically characterized as follows:

TABLE

| Diesel Fuel Cut From H-Oil | |
|---|---|
| Flash Point, °F. CM | 280 |
| Cloud Point, °F. | +5 |
| Pour Point, °F. | 0 |
| Kin. Vis. cS @ 40° F. | 4.3 |
| Cetane | 50.6 |
| FIA Analysis | |
| A % | 35.5 |
| O % | 12.5 |
| S % | 52.0 |
| S % | 0.41 |
| Con. Cu strip 3 hrs. 122° F. | 1A |
| API Gravity | 31.4 |
| ASTM Distillation, °.F | |
| IBP | 540 |
| 10% | 556 |
| 30% | 561 |
| 50% | 566 |
| 70% | 572 |
| 90% | 582 |
| EP | 593 |

The charge polyamine compositions which may be employed in practice of the process of this invention according to certain of its aspects may include primary amines or secondary amines. The amines may typically be characterized by the formula

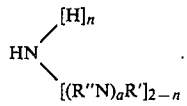

In these formula, a may be a number 1–20, preferably 1–10, say 5; and n may be 0 or 1.

In the above compound, R′ may be hydrogen or a hydrocarbon group selected from the group consisting of alkyl, aralkyl, cycloalkyl, aryl, and alkaryl, including such radicals when inertly substituted. When R′ is alkyl, it may typically be methyl, ethyl, n-propyl, iso-propyl, n-butyl, i-butyl, sec-butyl, amyl, octyl, decyl, octadecyl, etc. When R′ is aralkyl, it may typically be benzyl, beta-phenylethyl, etc. When R′ is cycloalkyl, it may typically be cyclohexyl, cycloheptyl, cyclooctyl, 2-methylcyclo-heptyl, 3-butylcyclohexyl, 3-methylcyclohexyl, etc. When R′ is aryl, it may typically be phenyl, naphthyl, etc. When R′ is alkaryl, it may typically be tolyl, xylyl, etc. When R′ is alkenyl, it may typically be vinyl, allyl, 1-butenyl, etc. R′ may be inertly substituted i.e. it may bear a non-reactive substituent such as alkyl, aryl, cycloalkyl, ether, etc. Typically inertly substituted R′ groups may include 2-ethoxyethyl, carboethoxymethyl, 4-methyl cyclohexyl, etc. The preferred R′ groups may be hydrogen or lower alkyl, i.e. $C_1$–$C_{10}$ alkyl, groups including e.g. methyl, ethyl, n-propyl, i-propyl, butyls, amyls, hexyls, octyls, decyls, etc. R′ may preferably be hydrogen.

R″ may be a hydrocarbon selected from the same group as R′ subject to the fact that R″ is divalent and contains one less hydrogen. Preferably R′ is hydrogen and R″ is $—CH_2CH_2$. Typical amines which may be employed may include the following:

TABLE propylenediamine
diethylenetriamine
triethylenetetramine
tetraethylenepentamine
pentaethylenehexamine, etc.

The preferred amine may be tetraethylenepentamine.

The charge aldehyde which may be employed may include those preferably characterized by the formula $R^2CHO$.

In the above compound, $R^2$ may be hydrogen or a hydrocarbon group selected from the group consisting of alkyl, aralkyl, cycloalkyl, aryl, and alkaryl, including such radicals when inertly substituted. When $R^2$ is alkyl, it may typically be methyl, ethyl, n-propyl, iso-propyl, n-butyl, i-butyl, sec-butyl, amyl, octyl, decyl, octadecyl, etc. When $R^2$ is aralkyl, it may typically be benzyl, beta-phenylethyl, etc. When $R^2$ is cycloalkyl, it may typically be cyclohexyl, cycloheptyl, cyclooctyl 2-methylcyclo-heptyl, 3-butylcyclohexyl, 3-methylcyclohexyl, etc. When $R^2$ is aryl, it may typically be phenyl, naphthyl, etc. When $R^2$ is alkaryl, it may typically be tolyl, xylyl, etc. $R^2$ may inertly substituted i.e. it may bear a non-reactive substituent such as alkyl, aryl, cycloalkyl, ether, etc. Typically inertly substituted R groups may include 2-ethoxyethyl, carboethyoxymethyl, 4-methyl cyclohexyl, etc. The preferred $R^2$ groups may be lower alkyl, i.e. $C_1$–$C_{10}$ alkyl, groups including e.g. methyl, ethyl, n-propyl, i-propyl, butyls, amyls, hexyls, octyls, decyls, etc. $R^2$ may preferably be hydrogen.

Typical aldehydes which may be employed may include the following:

TABLE formaldehyde
ethanal
propanal
butanal etc.

The preferred aldehyde may be formaldehyde employed as its polymer-paraformaldehyde.

The charge phenols which may be employed in practice of the process of this invention may preferably be characterized by the formula $HR^3OH$. It is a feature of these phenols that they contain an active hydrogen which will be the site for substitution. Poly-phenols (e.g. compounds containing more than one hydroxy group in the molecule whether on the same ring or not) may be employed. The rings on which the hydroxy groups are sited may bear inert substitents. However at least one position which may be meta-, but which preferably ortho- or para- to a phenol hydroxy group, must be occupied by an active hydrogen as this is the point of reaction with the aldehyde group.

$R^3$ may be an arylene group typified by $—C_6H_4—$, $—C_6H_3(CH_3)—$, $—C_6H_3(C_2H_5)—$, etc.

A preferred class of phenols may be hindered phenols characterized by the presence of one (or preferably two) groups ortho- to the —OH; and these groups are preferably groups which are bulky i.e. which sterically block the —OH group. Most common of such groups are tertiary alkyl groups typified by t-butyl, t-amyl, etc.

Typical phenols which may be employed may include:

TABLE phenol
2,6-di-t-butyl phenol
beta-naphthol resorcinol

The preferred phenol may be the hindered phenol: 2,6-di-t-butyl phenol.

Reaction to form the phenol-amine-aldehyde Mannich condensate may be effected by adding 0.1–1.3 moles, say 0.2–1.5 moles of aldehyde and 0.1–1.3 moles, say 1 mole of phenol. In one preferred embodiment, one mole of paraformaldehyde may react with one mole of 2,6-di-t-butyl phenol and 1 mole of tetraethylene pentamine.

Reaction is preferably affected by adding the reactants (preferably the aldehyde is added last) to a reaction operation under a blanket of inert gas, typically nitrogen. The reaction mixture is maintained at 80° C.–160° C., say about 100° C. for 0.5–5 hours, say 2 hours. By-product water distills off.

Typically reaction may be as follows:

$$R'(NR'')_aNH_2 + \underset{H}{\overset{R^2}{C}}{=}O + HR^3OH \longrightarrow R'(NR'')_aNH\underset{H}{\overset{R^2}{C}}R^3OH + H_2O$$

In a specific embodiment, the reaction may be as follows:

$$H_2NC_2H_4NH_2 + \underset{H}{\overset{H}{C}}{=}O + HC_6H_4OH \longrightarrow H_2NC_2H_4NH\underset{H}{\overset{H}{C}}{-}C_6H_4OH + H_2O$$

Illustrative phenol-amine-aldehyde Mannich base condensates which may be so formed include the following:

TABLE

A.

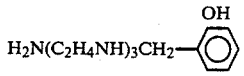

B.

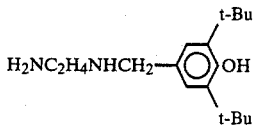

C.

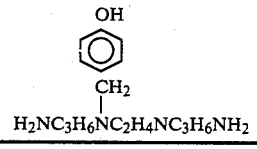

At the conclusion of the reaction, the products may be further reacted in situ although they may be filtered hot.

In practice of the process of this invention, the reagents may be simultaneously reacted with a succinic acid anhydride bearing a polyolefin substituent containing residual unsaturation in a "one pot reaction".

The succinic acid anhydride may be characterized by the following formula

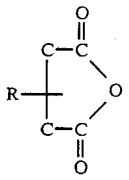

In the above formula, R may be a residue (containing residual unsaturation) from a polyolefin which was reacted with maleic acid anahydride to form the alkenyl succinic acid anhydride. R may have a molecular weight $\overline{M}_n$ of 500–2000, preferably 1000–1300, say about 1300.

Reaction is preferably carried out by adding 0.5–1 moles, say 1 mole of the phenol-amine Mannich base condensate, and 0.9–1.1 moles, say 1 mole of the alkenyl succinic acid anhydride. Reaction is preferably carried out in the presence of inert diluent-solvent typified by a heavy hydrocarbon. A preferred diluent-solvent is a hydrocarbon of lubricating oil character—preferably the lubricating oil in which the product is to be used. A more preferred diluent-solvent is the 100 E Pale Stock HF oil. The diluent-solvent is preferably present in amount of 0–50 w%, say 50 w% of the total of the other components of the reaction mixture.

Reaction is preferably carried out by adding the diluent-solvent oil, and the phenol-aldehyde-amine condensate to the reaction vessel. Preferably the reaction is carried out under a blanket of inert gas such as nitrogen. The reaction mixture may be heated to 30° C.–120° C., say 60° C. and the alkenyl succinic acid anhydride is added with agitation. The mixture is heated to 100° C.–160° C., say 110° C.–120° C. for 1–6 hours, say 2 hours and then filtered hot.

In the preferred embodiment, reaction may be carried out by forming the phenol-aldehyde-amine Mannich condensate in situ. The several charge materials may be added to the reaction system via the phenol, aldehyde, amine, anhydride, and diluent-solvent oil. The reaction mixture may be heated at 100° C.–160° C., say 115° C. for 1–6 hours, say 2 hours and then filtered hot.

The product so obtained may be a 50–80 w %, say 50 w % solution of the desired additive in inert diluent; and preferably it is used in this form.

The typical reaction may be as follows:

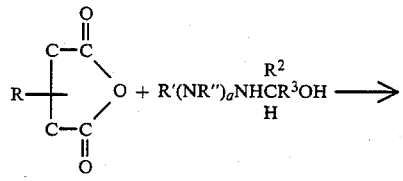

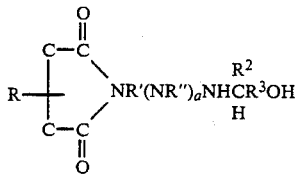

In a specific preferred embodiment, the reaction may be as follows:

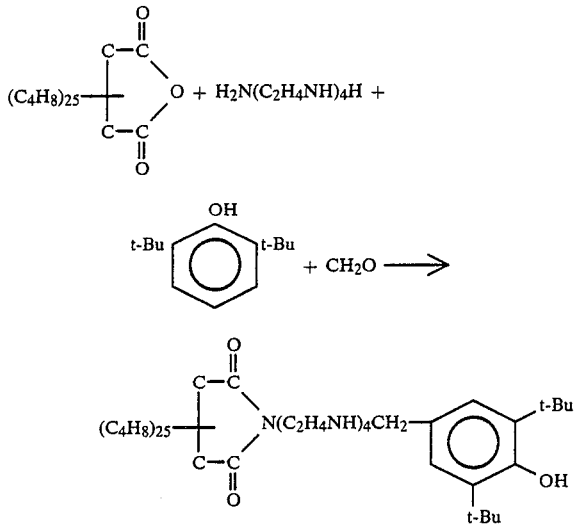

The products so formed may be acylated by reaction with an acylating agent. The acylating agent may be a carboxylic acid, a carboxylic acid anhydride, a carboxylic acid halide, etc. When the agent is a carboxylic acid, it may be a monocarboxylic acid such as acetic acid, propionic acid, butyric acid, etc. When it is a dicarboxylic acid, it may be oxalic acid, malonic acid, succinic acid, etc. When it is a polycarboxylic acid it may be trimellic acid, tricarboxylic acid, tetrahydrofuran-2,3,4,5-tetracarboxylic acid etc. When it is a halide, it may be acetyl chloride etc. When it is anhydride, it may be acetic anhydride etc.

One preferred group of acids may be characterized by the formula $$[(HO)_{1-x}(HOR'')_x]_y-\underset{\underset{R^*_{3-y}}{|}}{C}-COOH$$

In the above compound, R* may be hydrogen or a hydrocarbon group selected from the group consisting of alkyl, aralkyl, cycloalkyl aryl, and alkaryl, including such radicals when inertly substituted. When R* is alkyl, it may typically be methyl, ethyl, n-propyl, iso-propyl, n-butyl, i-butyl, sec-butyl, amyl, octyl, decyl, octadecyl, etc. When R* is aralkyl, it may typically be benzyl, beta-phenylethyl, etc. When R* is cycloalkyl, it may typically be cyclohexyl, cycloheptyl, cyclooctyl, 2-methylcyclo-heptyl, 3-butylcyclohexyl, 3-methylcyclohexyl, etc. When R* is aryl, it may typically be phenyl, naphthyl, etc. When R* is alkaryl, it may typically be tolyl, xylyl, etc. R* may be inertly substituted i.e. it may bear a non-reactive substituent such as alkyl, aryl, cycloalkyl, ether, etc. Typically inertly substituted R* groups may include 2-ethoxyethyl, carboethoxymethyl, 4-methyl cyclohexyl, etc. The preferred R* groups may be lower alkyl, i.e. $C_1$–$C_{10}$ alkyl, groups including e.g. methyl, ethyl, n-propyl, i-propyl, butyls, amyls, hexyls, octyls, decyls, etc. R* may preferably be n-propyl.

In the above formula, R'' may be a hydrocarbon group selected from the group consisting of alkylene, aralkylene, cycloalkylene, arylene, and alkarylene, including such radicals when inertly substituted. When R'' is alkylene, it may typically be methylene, ethylene, n-propylene, iso-propylene, n-butylene, i-butylene, sec-butylene, amylene, octylene, decylene, octadecylene, etc. When R'' is aralkylene, it may typically be benzylene, beta-phenylethylene, etc. When R'' is cycloalkylene, it may typically be cyclohexylene, cycloheptylene, cyclooctylene, 2-methylcycloheptylene, 3-butylcyclohexylene, 3-methylcyclohexylene, etc. When R'' is arylene, it may typically be phenylene, naphthylene, etc. When R'' is alkarylene, it may typically be tolylene, xylylene, etc. R'' may be inertly substituted i.e. it may bear a non-reactive substituent such as alkyl, aryl, cycloalkyl, ether, etc. Typically inertly substituted R'' groups may include 3-chloropropylene, 2-ethoxyethylene, carboethoxymethylene, 4-methyl cyclohexylene, etc. The preferred R'' groups may be lower alkylene, i.e. $C_1$–$C_{10}$ alkylene, groups including e.g. methylene, ethylene, n-propylene, i-propylene, butylene, amylene, hexylene, octylene, decylene, etc. R'' may preferably be ethylene $—CH_2CH_2—$.

In the above formula x may be 0 or 1 and y may be 0, 1 or 2.

The preferred acylating agents may be oxalic acid; glycolic acid; lactic acid; 2-hydroxymethyl propionic acid, and 2,2-bis(hydroxymethyl) propionic acid.

It is a feature of the process of this invention that a urea may also be used as acylating agent. Ureas may include substituted ureas typified by methyl urea $H_2NCONH(CH_3)$ etc. Preferred is urea i.e. $CO(NH_2)_2$.

Acylation may be effected preferably by addition of the acylating agent (e.g. oxalic acid or glycolic acid) to the reaction product of the Mannich condensate and the succinic acid anhydride, alternatively, although much less preferred, is the acylation of the Mannich condensate prior to reaction with the succinic acid anhydride or acylation of the amine prior to formation of the Mannich condensate.

Thus in the preferred embodiment, the Mannich condensate is formed in the reaction vessel. The alkenyl succinic acid anhydride (together with diluent oil) is then added. After this reaction is completed, the acylating agent is then added; and acylation occurs.

Acylation is preferably effected by adding the acylating agent (typically oxalic acid or glycolic acid) in amount of 0.1–1.1, preferably 0.5–1, say 0.9 moles per mole of active nitrogen.

It will be apparent that the reaction product of the Mannich condensate and the succinic acid anhydride contains a plurality of nitrogen-containing groups; and it is preferred that the amount of acylating agent be such that at least 30 atom %, preferably 50% 100%, say 85% of the nitrogen atoms be acylated.

During acylation, the carboxyl group of the acylating agent bonds to a nitrogen atom to form an amide. When the acylating agent contains a plurality of carboxyl groups, then the latter bond to different nitrogen atoms to form more complex structures including ring structures or cross-linked products. When urea is employed as acylating agent, the group which becomes bonded to the nitrogen atoms is $—CONH_2$; and ammonia is split out:

$$—NH+CO(NH_2)_2 \rightarrow NH_3+—NCONH_2$$

Acylated product may be in one of its embodiments be represented by the formula

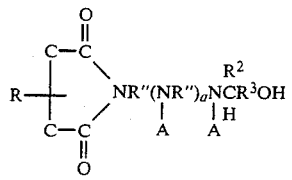

wherein A is selected from the same group as R′ or is a residue of the acylating agent (at least one A being acyl), bonded to the nitrogen atom by a bond which is typically

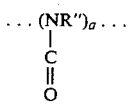

or in the case of urea (as acylating agent)

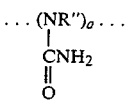

It is a feature of the products of this invention that they are effective stability additives in middle distillate fuels typified by diesel fuel derived from H-Oil Process.

Generally satisfactory results are obtained in middle distillate oil compositions which contain a major portion of a lubricating oil and a minor effective portion of the products of this invention. Effective amounts of the product of this invention in a middle distillate oil composition may include 0.1–12 w %, preferably 3–8 w %, say about 5 w %. Lesser amounts may be employed but the results may then be achieved only to a lesser degree. Larger amounts may be used but no substantial additional advantage may thereby be attained.

DESCRIPTION OF PREFERRED EMBODIMENTS

Practice of the process of this invention will be apparent to those skilled in the art from the following wherein as elsewhere in this specification all parts are parts by weight unless otherwise stated.

EXAMPLE I

In this Example which represents the best mode presently known of practicing the process of this invention, the following reactants are employed:

| Reactant | Grams | Moles |
|---|---|---|
| 1. Pentaethylene hexamine | 43.4 | 0.167 |
| 2. 2,6-di-t-butyl phenol | 34.3 | 0.167 |
| 3. Formaldehyde (as paraformaldehyde) | 8 | 0.25 |
| 4. 100-E Pale Stock HF | 371 | — |
| 5. Polyisobutenyl ($\overline{M}_n$ 1290) succinic acid anhydride-Sap. No. 51.9 with 5.9 w % diluent oil (100 E Pale Stock HF) | 400 | 0.185 |
| 6. Silicone Oil Anti-foamant (1 ml) | | |
| 7. Oxalic Acid | 33.2 | 0.527 |

In this example, reactants 2–5 are added to a reaction vessel and nitrogen blanketed. The amine is then added with stirring and the mixture heated to 110° C.–115° C. and maintained for one hour. Antifoamant and oxalic acid are added and the reaction mixture maintained at 160° C. for 8 hours. The product is filtered hot.

The product of this Example is tested (in amount of 25 pounds per thousand barrels PTB) as an additive to the diesel fuel cut from H-oil detailed supra and the Ratings on the Potential Deposit Test PDT are set forth infra.

EXAMPLE II

In this Example, the following reactants are employed:

| Reactants | Grams | Moles |
|---|---|---|
| 1. Pentaethylene hexamine | 43.4 | 0.167 |
| 2. 2,6-di-t-butyl phenol | 34.3 | 0.167 |
| 3. Formaldehyde (as paraformaldehyde) | 8 | 0.25 |
| 4. 100 E Pale Stock HF | 371 | — |
| 5. Polyisobutenyl ($\overline{M}_n$ 1290) succinic acid anhydride-Sap. No. 51.9 with 5.9 w % diluent oil (100 E Pale Stock HF Oil) | 400 | 0.185 |
| 6. Glycolic Acid (6.58% Free; 71.4 Total Acid) | 62 | 0.527 |

In this Example, the procedure followed is comparable to Example I.

The product of this Example is tested (in amount of 25 pounds per thousand barrels PTB) as an additive to the diesel fuel cut from H-Oil detailed supra and the Ratings on the Potential Deposit Test PDT are set forth infra.

EXAMPLE III

| Reactants | Grams | Moles |
|---|---|---|
| 1. Pentaethylene hexamine | 43.4 | 0.165 |
| 2. 2,6-di-t-butyl phenol | 34.3 | 0.167 |
| 3. Formaldehyde (as paraformaldehyde) | 8 | 0.25 |
| 4. 100 E Pale Stock HF | 371 | — |
| 5. Indopol H-100 brand of Polyisobutenyl $\overline{M}_n$ 1290) succinic acid anhydride-Sap. No. 51.9 with 5.9 w % diluent oil (100 E Pale Stock HF Oil) | 400 | 0.185 |
| 6. Silicone Oil Anti-foamant (0.1 ml) | | |
| 7. Urea | 31.6 | 0.527 |

In this example, the procedure followed is comparable to Example I except that all of the reactants are added simultaneously and the reaction mixture is heated at 140° C. for 3 hours.

The product of this Example is tested (in amount of 25 pounds per thousand barrels PTB) as an additive to the diesel fuel cut from H-Oil detailed supra and the Ratings on the Potential Deposit Test PDT are set forth infra.

EXAMPLE IV

In this example, the following reactants are employed:

| Reactants | Grams | Moles |
|---|---|---|
| 1. Tetraethylene pentamine | 500 | 2.64 |
| 2. 2,6-di-t-butyl phenol | 545 | 2.64 |
| 3. Formaldehyde (as paraformaldehyde) | 120 | 3.98 |
| 4. 100 E Pale Stock HF | 420 | — |
| 5. Indopol H-300 brand of Polyisobutenyl ($\overline{M}_n$ 1290) | 400 | 0.185 |

-continued

| Reactants | Grams | Moles |
|---|---|---|
| succinic acid anhydride-Sap. No. 51.9 with 5.9 w % diluent oil (100 E Pale Stock HF Oil) | | |
| 6. Silicone Oil Anti-foamant (0.5 ml) | — | — |
| 7. Urea | 25 | 0.418 |

In this Example, the amine and phenol and formaldehyde are added to the reaction vessel and heated to 100° C. for 2 hours. 70 g of this material is then added to the acid anhydride, Pale Stock, urea, and anti-foamant. This mixture is heated to 130° C. for 2 hours and then filtered hot.

The product of this Example is tested (in amount of 25 pounds per thousand barrels PTB) as an additive to the diesel fuel cut from H-Oil detailed supra and the Ratings on the Potential Deposit Test PDT are set forth infra.

EXAMPLE V

In this Example, the following reactants are employed:

| Reactants | Grams | Moles |
|---|---|---|
| 1. Tetraethylene pentamine | 315 | 1.67 |
| 2. 2,6-di-t-butyl phenol | 343 | 1.67 |
| 3. Formaldehyde (as paraformaldehyde) | 80 | 2.5 |
| 4. 100 E Pale Stock_HF | 3830 | — |
| 5. Polyisobutenyl ($\overline{M}_n$ 1290) succinic acid anhydride-Sap. No. 51.9 with 5.9 w % diluent oil (100 E Pale Stock HF Oil) | 4000 | 1.85 |
| 6. Silicone Oil Anti-foamant (1 ml) | | |
| 7. Oxalic acid (dihydrate) | 276 | 2.5 |

In this example, the procedure followed is comparable to Example I.

The product of this Example is tested (in amount of 25 pounds per thousand barrels PTB) as an additive to the diesel fuel cut from H-Oil detailed supra and the Ratings on the Potential Deposit Test PDT are set forth infra.

The results of the Potential Deposit Test are as follows (Example VI shows the rating of the Diesel Fuel Cut from H-Oil with no additives):

TABLE

| Example | Rating |
|---|---|
| I | 1 |
| II | 2 |
| III | 1 |
| IV | 2 |
| V | 2 |
| VI | 3 |

From this Table, it is apparent that the systems of this invention permit attainment of improved results on the PDT. Specifically the addition of 25 PTB of the system of this invention permits a decrease in the PDT rating to a desirably lower level of 1–2.

Results comparable to those attained in Example I may be attained if the acylating agent is as follows:

TABLE

| Example | Acylating Agent |
|---|---|
| VII | acetic acid |

TABLE-continued

| Example | Acylating Agent |
|---|---|
| VIII | propionic acid |
| IX | butyric acid |
| X | lactic acid |

Although this invention has been illustrated by reference to specific embodiments, it will be apparent to those skilled in the art that various changes and modifications may be made which clearly fall within the scope of this invention.

What is claimed is:

1. A liquid middle distillate fuel composition comprising a major portion of a liquid middle distillate hydrocarbon fuel and a minor effective portion of additive prepared by reacting (i) a primary or secondary polyamine, (ii) an aldehyde, and (iii) a phenol containing an active hydrogen thereby forming a phenol-aldehyde-amine condensate;

reacting said phenol-aldehyde-amine condensate with (iv) a succinic acid anhydride bearing a polyolefin-derived substituent containing residual unsaturation thereby forming product phenol-aldehyde-amine Mannich condensate polyamine succinimide; and acylating said phenol-aldehyde-amine Mannich condensate polyamine succinimide with acylating agent thereby forming acylated phenol-aldehyde-amine Mannich condensate polyamine.

2. A liquid middle distillate fuel composition as claimed in claim 1 wherein said middle distillate is a diesel fuel.

3. A liquid middle distillate fuel composition as claimed in claim 1 wherein said middle distillate is a fuel oil.

4. A liquid middle distillate fuel composition as claimed in claim 1 wherein said amine is tetraethylene pentamine.

5. A liquid middle distillate fuel composition as claimed in claim 1 wherein said amine is pentaethylene tetramine.

6. A liquid middle distillate fuel composition as claimed in claim 1 wherein said aldehyde is formaldehyde.

7. A liquid middle distillate fuel composition as claimed in claim 1 wherein said phenol is a hindered phenol.

8. A liquid middle distillate fuel composition as claimed in claim 1 wherein said phenol is 2,6-di-t-butyl phenol.

9. A liquid middle distillate fuel composition as claimed in claim 1 wherein said acrylating agent is a carboxylic acid.

10. A liquid middle distillate fuel composition as claimed in claim 1 wherein said acylating agent is glycolic acid.

11. A liquid middle distillate fuel composition as claimed in claim 1 wherein said acylating agent is oxalic acid.

12. A liquid middle distillate fuel composition as claimed in claim 1 wherein said acylating agent is urea.

13. A liquid middle distillate fuel composition as claimed in claim 1 wherein said effective amount is 0.1–12 wt. %.

14. A liquid middle distillate fuel composition comprising a major portion of a liquid middle distillate hydrocarbon fuel and a minor effective portion of 0.1–12 wt. % of additive prepared by reacting pentaethylene tetramine, formaldehyde, and 2,6-di-t-butyl phenol thereby forming a phenol-aldehyde-amine condensate;

reacting said phenol-aldehyde-amine condensate with polyisobutenyl succinic acid anhydride thereby forming product phenol-aldehyde-amine Mannich condensate polyamine succinimide; and acylating said product phenol-aldehyde-amine Mannich condensate polyamine succinimide with oxalic acid.

15. The method which comprises adding to a major portion of a liquid middle distillate fuel composition a minor effective portion of additive prepared by reacting (i) a primary or secondary polyamine, (ii) an aldehyde, and (iii) a phenol containing an active hydrogen thereby forming a phenol-aldehyde-amine condensate;

reacting said phenol-aldehyde-amine condensate with (iv) a succinic acid anhydride bearing a polyolefin-derived substituent containing residual unsaturation thereby forming product phenol-aldehyde-amine Mannich condensate polyamine succinimide; and acylating said phenol-aldehyde-amine Mannich condensate polyamine succinimide with acylating agent thereby forming acylated phenol-aldehyde-amine Mannich condensate polyamine.

16. A product prepared by the process which comprises reacting (i) a primary or secondary polyamine, (ii) an aldehyde, and (iii) a phenol containing an active hydrogen thereby forming a phenol-aldehyde-amine condensate;

reacting said phenol-aldehyde-amine condensate with (iv) a succinic acid anhydride bearing a polyolefin-derived substituent containing residual unsaturation thereby forming product phenol-aldehyde-amine Mannich condensate polyamine succinimide; and acylating said phenol-aldehyde-amine Mannich condensate polyamine succinimide with acylating agent thereby forming acylated phenol-aldehyde-amine Mannich condensate polyamine.

17. A product as claimed in claim 16 wherein said amine is tetraethylene pentamine.

18. A product as claimed in claim 16 wherein said amine is pentaethylene tetramine.

19. A product as claimed in claim 16 wherein said aldehyde is formaldehyde.

20. A product as claimed in claim 16 wherein said phenol is a hindered phenol.

21. A product as claimed in claim 16 wherein said phenol is 2,6-di-t-buryl phenol.

22. A product as claimed in claim 16 wherein said acrylating agent is a carboxylic acid.

23. A product as claimed in claim 16 wherein said acylating agent is glycolic acid.

24. A product as claimed in claim 16 wherein said acrylating agent is oxalic acid.

25. A product as claimed in claim 16 wherein said acrylating agent is urea.

26. A product prepared by the process which comprises reacting pentaethylene tetramine, formaldehyde, and 2,6-di-t-butyl phenol thereby forming a phenol-aldehyde-amine condensate;

reacting said phenol-aldehyde-amine condensate with polyisobutenyl succinic acid anhydride thereby forming product phenol-aldehyde-amine Mannich condensate polyamine succinimide; and acylating said product phenol-aldehyde-amine Mannich condensate polyamine succinimide with oxalic acid.

27.

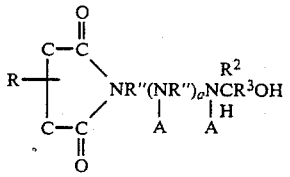

wherein

R is a residue, containing residual unsaturation, from a polyolefin;

R′ and R$^2$ are hydrogen or hydrocarbon group selected from the group consisting of alkyl, alkaryl, aralkyl, cycloalkyl, and aryl;

R″ is a divalent hydrocarbon group selected from the group consisting of alkylene, alkarylene, aralkylene, cycloalkylene, and arylene;

R$^3$ is an arylene group; and

A is selected from the same group as R′ or is a residue of an acylating agent, at least one A being other than hydrogen or A equals R′; and a is 1–20.

* * * * *